US007913323B2

(12) United States Patent
Takamoto et al.

(10) Patent No.: US 7,913,323 B2
(45) Date of Patent: Mar. 29, 2011

(54) GARMENT

(75) Inventors: Yoshikuni Takamoto, Kobe (JP); Yoshie Tsuji, Kobe (JP); Mamoru Omuro, Kobe (JP)

(73) Assignee: ASICS Corporation, Kobe (JP)

( * ) Notice: Subject to any disclaimer, the term of this patent is extended or adjusted under 35 U.S.C. 154(b) by 0 days.

(21) Appl. No.: 11/922,996

(22) PCT Filed: Jan. 12, 2006

(86) PCT No.: PCT/JP2006/300268

§ 371 (c)(1),
(2), (4) Date: Dec. 28, 2007

(87) PCT Pub. No.: WO2007/007433

PCT Pub. Date: Jan. 18, 2007

(65) Prior Publication Data

US 2009/0077708 A1 Mar. 26, 2009

(30) Foreign Application Priority Data

Jul. 8, 2005 (JP) ..... 2005-200242

(51) Int. Cl.
*A41D 13/00* (2006.01)

(52) U.S. Cl. ..... 2/115; 2/69

(58) Field of Classification Search ..... 2/115, 69, 2/79, 122, 106, 77, 467, 102, 108, 113, 90, 2/67, 121, 85, 93; 482/124
See application file for complete search history.

(56) References Cited

U.S. PATENT DOCUMENTS 1,949,312 A * 2/1934 Konski ..... 2/122
2,280,479 A * 4/1942 Coben ..... 2/76
2,986,740 A * 6/1961 Schudson ..... 2/115
3,137,860 A * 6/1964 Bindler ..... 2/115
3,453,662 A * 7/1969 Weiss ..... 2/115
5,109,546 A * 5/1992 Dicker ..... 2/70
(Continued)

FOREIGN PATENT DOCUMENTS

DE 69815792 T2 5/2004
(Continued)

OTHER PUBLICATIONS

Office Action dated May 11, 2010, issued by the German Patent and Trademark Office in connection with German Patent Application No. 11 2006 001 821.3-26, including English translation (6 pages).

*Primary Examiner* — Amy B Vanatta
(74) *Attorney, Agent, or Firm* — Michael E. Zall

(57) ABSTRACT

It is an object of the present invention to provide an upper body garment that is capable of facilitating the action of raising the arms while reducing the activities of muscles by preventing unnecessary restriction of the muscles. The upper body garment is characterized in that a low stretchable portion is disposed in a predetermined area of the back side of the garment. The predetermined area extends from one end side to the opposite end side in the width direction of the back side of the garment and contains at least areas in which the inferior angles of the right and left scapulas are respectively displaced during raising the arms. The low stretchable portion has a stretching ratio smaller in the width direction of the back side than an area near at least a neck portion of the back side.

18 Claims, 8 Drawing Sheets

U.S. PATENT DOCUMENTS

| | | | | | |
|---|---|---|---|---|---|
| 5,367,708 | A | * | 11/1994 | Fujimoto | 2/22 |
| 5,737,772 | A | * | 4/1998 | Dicker et al. | 2/69 |
| 5,829,058 | A | * | 11/1998 | Dicker et al. | 2/69 |
| 5,839,122 | A | * | 11/1998 | Dicker et al. | 2/67 |
| 5,857,947 | A | * | 1/1999 | Dicker et al. | 482/124 |
| 5,937,442 | A | * | 8/1999 | Yamaguchi et al. | 2/69 |
| 6,047,406 | A | | 4/2000 | Dicker et al. | |
| 6,353,934 | B1 | * | 3/2002 | Tada et al. | 2/115 |
| 6,446,264 | B2 | * | 9/2002 | Fairhurst et al. | 2/69 |
| 6,892,396 | B2 | * | 5/2005 | Uno et al. | 2/115 |
| 7,636,950 | B2 | * | 12/2009 | Melhart et al. | 2/69 |

FOREIGN PATENT DOCUMENTS

| | | |
|---|---|---|
| JP | SHO-46-042809 | 5/1971 |
| JP | 9-250008 | 9/1997 |
| JP | 3115816 | 9/2000 |
| JP | 2001-262409 | 9/2001 |
| JP | 2003-129310 | 5/2003 |
| JP | 2004-44070 | 2/2004 |
| JP | 2004-204420 | 7/2004 |
| JP | 2004-263362 | 9/2004 |

* cited by examiner 1
2
3
4
10
11

GARMENT

TECHNICAL FIELD

The present invention relates to a garment that is tightly fitted to the body of a wearer when in use and particularly an upper body garment that is tightly fitted to the upper body when in use.

BACKGROUND ART

Hitherto, there have been proposed garments that are intended to improve an arm raising movement involved in such as a pitching motion in a baseball game or a shooting motion in a basket ball game (e.g., Patent Documents 1 and 2).

These garments are designed to enhance the athletic ability by directly supporting arm muscles, shoulder muscles, etc., which function during raising the arms, and specifically have a low stretchable portion in which a low stretchable material is disposed to extend in the muscle fiber directions of these muscles, and utilize the restoring resilience caused at the time when the low stretchable portion has been stretched.

Patent Document 1: Japanese Patent No. 3115816

Patent Document 2: Japanese Patent Application Laid-open No. 2004-44070

DISCLOSURE OF THE INVENTION

Problems to be Solved by the Invention

These garments are thus required to have the low stretchable portion once stretched during a series of movements to raise the arms from a lower position to an upper position in order to generate the restoring resilience. This is realized by the movements of the muscles, and results in that the low stretchable portion may restrict the muscles. Thus, the amount of the activities of the muscles is necessarily increased so that those garments are not necessarily effective from the viewpoint of the purpose of facilitating the movement to raise the arms, and may not provide a comfortable fit.

Accordingly, it is an object of the present invention to provide an upper body garment that is capable of facilitating the arm raising movement while reducing the activities of muscles by preventing unnecessary restriction of the muscles.

Means to Solve the Problem

A garment of the present invention is characterized in that a low stretchable portion is disposed in a predetermined area of the back side of the garment, in which the predetermined area extends from one end side to the opposite end side in the width direction of the back side of the garment and contains at least areas in which the inferior angles of the right and left scapulas are respectively displaced during raising the arms, and the low stretchable portion has a stretching ratio smaller in the width direction of the back side than that of at least an area near a neck portion of the back side. The area near the neck portion is an area above the predetermined area, and is intended not to include, for example, a portion around the neck that is provided to reinforce an edge of the garment.

Alternatively, a low stretchable portion is disposed in a predetermined area of the back side of the garment in which the predetermined area extends from one end side to the opposite end side in the width direction of the back side of the garment and contains at least areas in which the inferior angles of the right and left scapulas are respectively displaced during raising the arms, and the low stretchable portion has a stretching ratio smaller in the width direction of the back side than that of an area of the back side other than the predetermined area.

According to the thus arranged garment, the predetermined area provided with the low stretchable portion contains at least areas in which the inferior angles of the scapulas are respectively displaced, so that the scapulas can be pressed towards the thoracic cage by having clothing pressure, which is generated by the low stretchable portion, acting on the inferior angles during raising the arms. The predetermined area is arranged to extend from one end side to the opposite end side in the width direction, so that tensile force applied from the opposite lateral sides of the garment, which correspond to the sides of the body of the wearer, can be efficiently acted on the low stretchable portion and hence clothing pressure can be efficiently generated. The low stretchable portion can also be stretched by friction between the low stretchable portion and its contacting surface. Whereby, the scapulas can smoothly slide on the thoracic cage and hence the activities of the muscles for moving the scapulas can be reduced. Especially, when the abduction of the arm is entailed, it is possible to reduce the activities of the serratus anterior and the upper fibres of the trapezium.

In this case, the predetermined area may be arranged to have boundaries to the area of the back side other than the predetermined area, in which the boundaries are respectively located between areas in which the superior angles of the scapulas are displaced and the areas in which the inferior angles of the scapulas are displaced. With this arrangement, clothing pressure is acted on a wider area corresponding to the lower sides of the scapulas so that the scapulas can be more effectively pressed towards the thoracic cage and hence the activities of the muscles for moving the scapulas can be more efficiently reduced.

The predetermined area may be arranged to have opposite lateral ends matched in position to boundaries of the back side and the front side. With this arrangement, tensile force applied from the opposite lateral sides of the garment can be efficiently acted on the low stretchable portion without being deteriorated or weakened, and hence clothing pressure can be efficiently generated.

Furthermore, the predetermined area may be arranged to have opposite lateral ends each having a height smaller than the height of a portion of the predetermined area, which portion containing at least the areas, in which the inferior angles of the scapulas are displaced. With this arrangement, the occupying ratio of the area having a stretching ratio small in the height direction becomes smaller relative to the entire height of each of the opposite lateral sides. Accordingly, even if the stretching ratio of the low stretchable portion in the height direction is smaller than that of a region in the area other than the low stretchable portion, the opposite lateral sides of the upper body garment as a whole can have a high stretching ratio in the height direction. Herein, the opposite lateral sides of the garment correspond in position to the sides of the body in which the skin is greatly stretched during raising the arms. The thus arranged garment facilitates the arm raising movement and can maintain a comfortable fit.

The predetermined area may be arranged to have a center portion in the width direction that extends downwards in the height direction. This enables giving pressure stimulation to the lower fibres of the trapezius over a wide range thereof, and effectively enables the wearer to enhance awareness to the muscles to be moved. Thus, it is possible to further facilitate the arm raising movement.

ADVANTAGE OF THE INVENTION

As described above, the garment of the present invention can facilitate the arm raising movement while reducing the activities of the muscles by preventing unnecessary restriction of the muscles.

BRIEF DESCRIPTION OF THE DRAWINGS

FIG. 1 are schematic views for explaining the abduction of the arm when viewed from the front side (breast side) of the human body, in which

FIG. 3 are views explaining the muscles engaged in raising the arm, in which

FIG. 5 are views explaining the positional relationship between a low stretchable portion and the inferior angle of the scapula when the abduction of the arm has been carried out with the upper body garment worn, in which

FIG. 6 are views for comparison of the amount of activities of the muscles in abduction of the arm, in which

FIG. 8 are plan views of the upper body garment according to another embodiment of the present invention, in which

DESCRIPTION OF THE REFERENCE NUMERALS

1: scapula, 2: superior angle, 3: acromio, 4: inferior angle, 5: inner side edge, 6: spine of scapula, 10: humerus, 11: clavicle, 21: torso portion, 22: torso portion, 23: sleeve portion, 24: boundary portion, 24*a*: lower edge portion, 25: low stretchable area, 26: high stretchable area, 27: inferior angle displacing area, 28: lateral side area, 29: center area, M1: serratus anterior, M2: upper fibres of the trapezium, M3: lower fibres of the trapezius

BEST MODE FOR CARRYING OUT THE INVENTION

The description will be hereinafter made for an embodiment of a garment according to the present invention. Now, an explanation will be provided for the mechanism of the action of a so-called "abduction of the arm" involved in raising the arm from an anatomical view point, before explaining the garment of this embodiment.

Specifically, the abduction of the arm is roughly classified into a first half movement in which mainly the humerus 10 is rotated while the scapula 1 is not greatly rotated, and a last half movement in which not only the humerus 10 but also the scapula 1 is rotated. FIG. 1 is a schematic view illustrating the abduction of the right arm as viewed from the front side (breast side) of the human body. Accordingly, the side of the scapula 1 facing the front side in FIG. 1 is a side facing the thoracic cage.

Figures 1A, 1B, 1C, 1D, 1E, 1F:
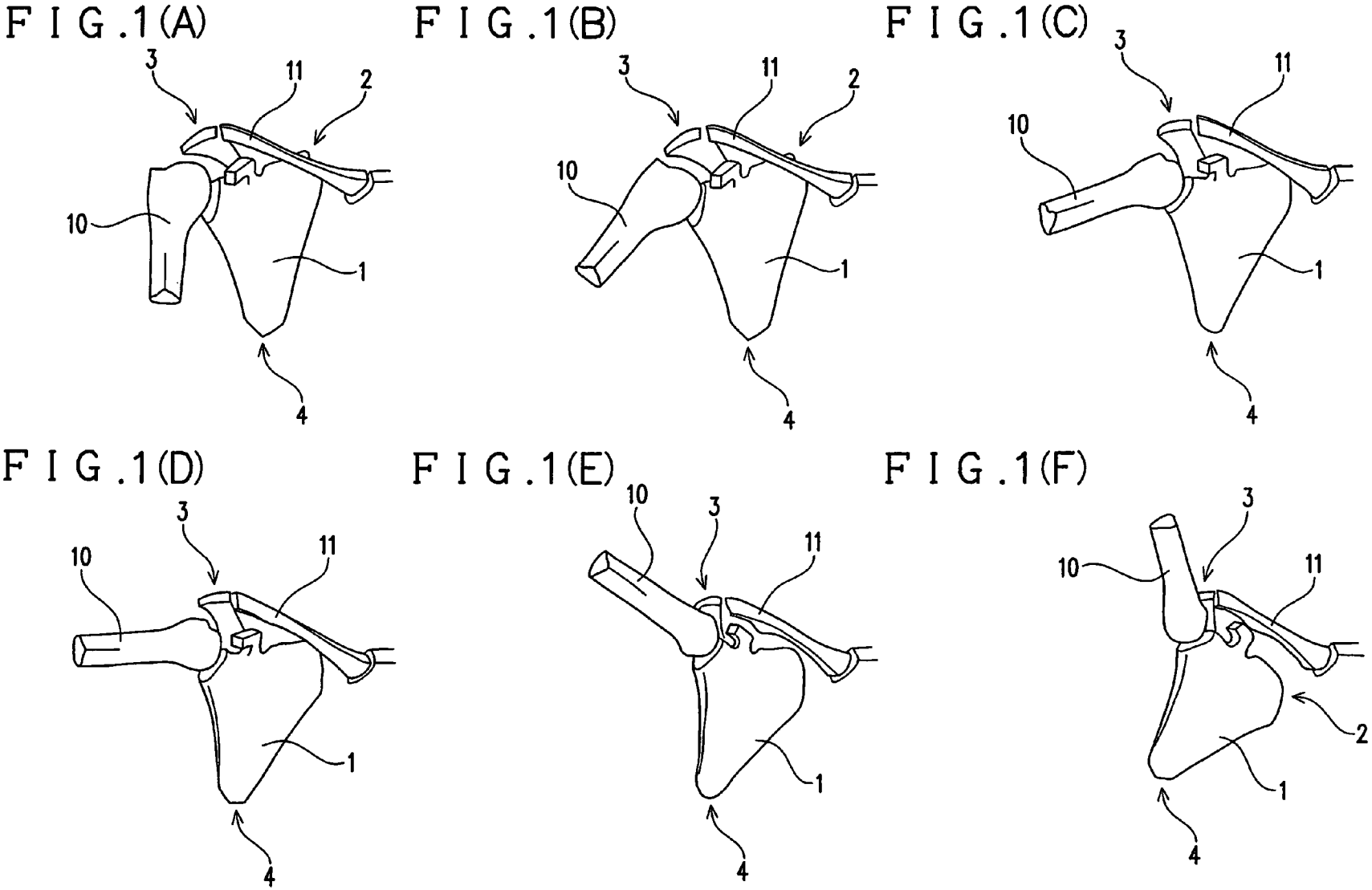
FIGS. 1(A) to 1(C) illustrate a first phase in which mainly the humerus is rotated.
FIGS. 1(D) to 1(F) illustrate a second phase in which not only the humerus but also the scapula is rotated.

More specifically, the abduction of the arm is classified into a first phase (FIGS. 1(A) to 1(C)) in which the abduction angle is 0° to about 90° through which mainly the humerus 10 is rotated, a second phase (FIGS. 1(D) to 1(F)) in which the abduction angle is about 90° to about 160° through which not only the humerus 10 but also the scapula 1 is rotated, and a third phase (not illustrated) in which the abduction angle is about 160° to about 180°. These movements are classified from the anatomical view point but this classification is not clear. For example, in the first phase, the scapula is slightly rotated in association with the movement of the humerus.

First, in the first phase, both the scapula 1 and the humerus 10 face the vertical lower side. When carrying out the abduction of the arm from this position, the humerus 10 held in the glenoid cavity of the scapula 1 is rotated. At this moment, muscles (prima mover agonist) which are chiefly responsible for raising the humerus 10 are muscles called as the deltoid and the supraspinatus muscle. The humerus 10 is rotatable without causing great movement of the scapula until the abduction angle reaches about 90°. On the other hand, when the abduction angle comes close to about 90°, the humerus 10 comes into a position enabling itself to contact the glenoid cavity of the scapula 1 and the like, so that further rotation of the humerus 10 is difficult to be made in the absence of the rotation of the scapula 1. Accordingly, the abduction of the arm is transferred to the second phase in which the scapula 1 is rotated.

Figure 2:
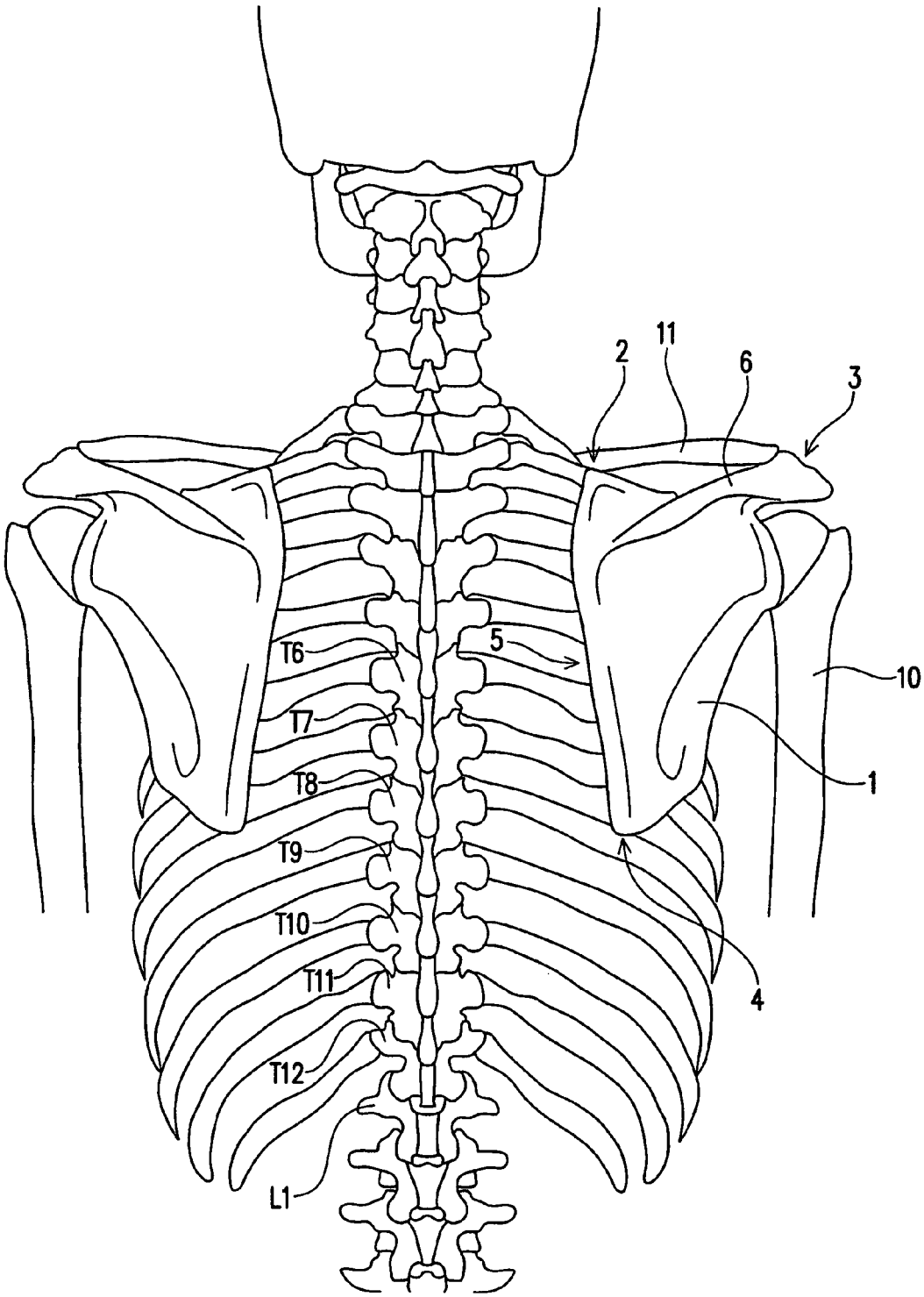
FIG. 2 is a schematic view illustrating the positional relationship between the scapula and the vertebral column.

Now, the description will be made for the scapula 1 with reference to FIG. 2. In FIG. 2A, a side of the scapula 1 facing the front side is the side opposite to the side of FIG. 1. The scapula 1 has an inverted triangular shape with the superior angle 2, the acromio 3 and the inferior angle 4 as the vertices, and is located between the second to eighth ribs in the upper portion of the back of the thoracic cage to provide connection between the arm and the torso. In addition to the connection to the humerus 10 and the clavicle 11 via joints, the scapula 1 is connected to the other bones by mainly muscles and ligaments so as to be relatively freely movable. Therefore, the rotation of the scapula 1 is achieved in such a manner as that the scapula 1 slides along the thoracic cage (this is called as "upward rotation" of the scapula). The upward rotation is made about a position near the superior angle 2, causing the inferior angle 4 to follow a circular trajectory. Generally, the inferior angle 4 of the scapula 1 is moved in an area of the height from the 8th thoracic vertebra (T8) to the 7th thoracic vertebra, of the vertebral column during the upward rotation. The scapula 1 is rotatable through about 45° relative to the vertical direction.

Figure 3B:
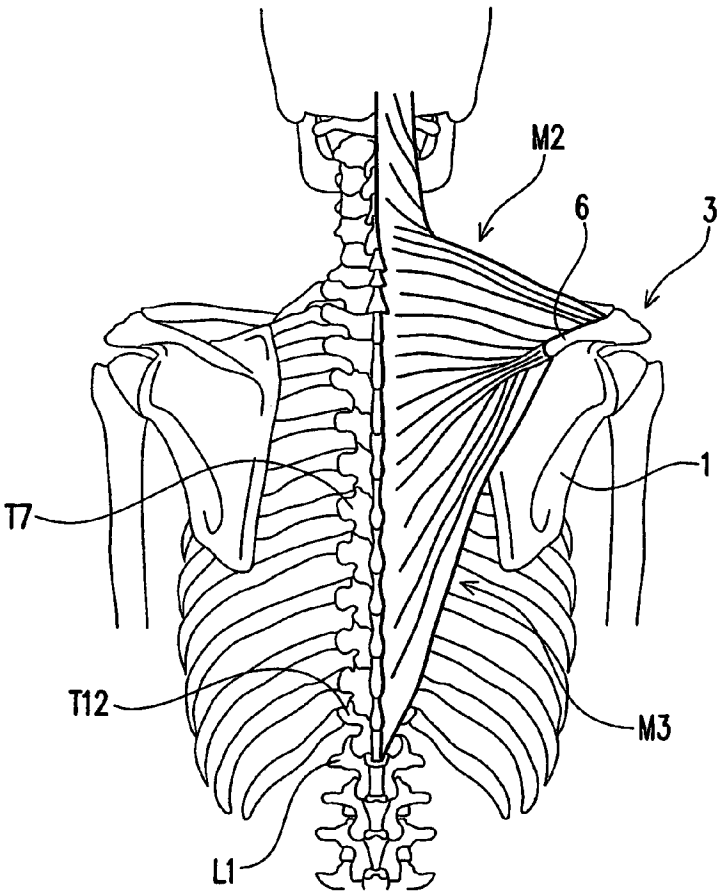
FIG. 3(A) illustrates the serratus anterior as viewed from a lateral side of the human body and FIG. 3(B) illustrates the upper fibres of the trapezius and the lower fibres of the trapezius as viewed from the back side of the human body.
Figure 3A:
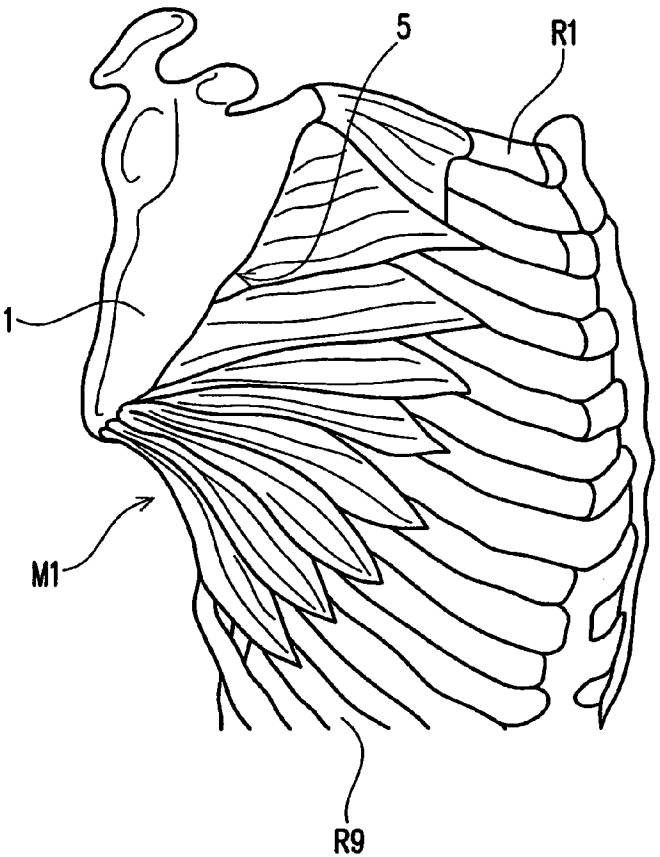

In the second phase, muscles (prima mover agonist) chiefly responsible for the upward rotation of the scapula are the serratus anterior M1 illustrated in FIG. 3(A) and the upper fibres of the trapezius M2 illustrated in FIG. 3(B). The serratus anterior M1 has starting portions at scapula 1st to 9th (or 8th) ribs (R1 to R9 (or R8), and is a muscle that extends through a portion between the scapula 1 and the thoracic cage (in FIG. 2, a space on the back side of the scapula 1) and has a terminal portion on the inner side edge 5 of the scapula 1, and acts to raise the scapula 1 when in the upward rotation of the scapula 1. The upper fibres of the trapezius M2 has starting portions on the occipital bone and the nuchal ligament, of the parietal bone, and terminal portions on a region extending from the spine of scapula 6 to the acromio 3 and the clavicle, and acts to suspend the scapula 1 and raise the scapula 1 when in the upward rotation. Herein, the serratus anterior M1 also acts to draw the scapula 1 close to the thoracic cage and hence acts to adjust the scapula 1 to a so-called "correct position". That is, the serratus anterior M1 has a first function to draw the scapula 1 close to the thoracic cage and a second function to realize the upward rotation of the scapula 1.

The abduction of the arm in the third phase is realized mainly by the increase of the forward bending of the lumbar vertebra, and the rotation of the scapula 1 and the humerus 10 does not act as a main contribution to the abduction of the arm.

As collateral knowledge, it is known in the field of physical therapy, such as rehabilitation, that the lower fibres of the trapezius M3 illustrated in FIG. 3(B) indirectly contribute in raising of the arm. Specifically, the lower fibres of the trapezius M3 constitute a muscle that has starting portions at the 7th thoracic vertebra to the 12th thoracic vertebra (T7 to T12), of the vertebral column illustrated in FIG. 2 and the supraspinous ligament, and has a terminal portion on the spine of scapula 6 of the scapula 1. The lower fibres of the trapezius M3 do not directly contribute to the abduction of the arm or the upward rotation of the scapula 1, but, by vigorous actions in an initial stage (herein, for example the first phase) of the abduction of the arm, act to reduce the activities of the serratus anterior M1 and the upper fibres of the trapezius M2 in a stage subsequent to the abduction (herein, for example the second phase).

In comparison between the first phase and the second phase in the abduction of the arm, the load of the muscles in the second phase is greater than that of the first phase due to the larger abduction angle in the second phase. Therefore, it is conceivable that reduction of the load of the muscles in the second phase would be effective to facilitate a series of abduction movements of the arm. In the second phase, the rotation of the scapula 1 is mainly made so that when the scapula 1 smoothly slides on the thoracic cage, it becomes effective in reducing the load of the muscles.

Meanwhile, due to the aforesaid connection of the scapula 1 to the humerus 10, the clavicle 11, etc. by the joints, the upper portion of the scapula 1 is relatively easy to be fixed in position but the lower portion of the scapula 1 is not easy to be fixed in position and hence is easy to be brought into a condition in which the lower side is held in a position at which it is lifted up from the thoracic cage, since the lower side is connected mainly by muscles. This is sometimes called "winged scapula". Under this condition in which the lower portion of the scapula 1 is being lifted up, it is necessary to displace the serratus anterior M1 and the upper fibres of the trapezius M2 more greatly than in a normal condition, and therefore the amount of activities of the muscles is increased. Thus, it is effective to bring the scapula 1 to a position close to the thoracic cage (i.e., the "correct position") in order to achieve smooth sliding of the scapula 1.

Now, the description will be made for the garment of this embodiment. The garment of this embodiment is tightly fitted to the body of the wearer when in use, and particularly is an upper body garment that is tightly fitted to the upper body. Therefore, its size is set slightly smaller than the body of the wearer (e.g., about 85 to 95%).

The upper body garment includes a back torso portion 21, a front torso portion 22, and right and left sleeves 21, 22 respectively attached to the pair of these torso portions 22, 23 along the front and rear sides of the torso portions.

Now, the description will be made for the structure of the back side of the garment.

The back torso portion 21 and the front torso portion 22 each have a substantially constant width from a waist portion to a predetermined height position along the height direction, and are gradually narrowed towards the upside from the predetermined height to a neck portion. The sleeves 23 are attached to edge portions which are narrowed to be slanted relative to the height direction and the width direction, and these edge portions act as boundaries between the torso portion 21 and the sleeves 23. Lower edge portions 24*a* of the boundaries 24 act as underarm portions of the upper body garment.

The sleeves 23 respectively have proximal end portions that define the edge of a neck opening, and are connected to upper ends of the respective torso portions 21, 22 to define the entire neck opening. A sleeve shape or an upper body garment having such a sleeve shape, in which the boundaries 24 between the torso portions 21, 22 and the sleeves 23 are slanted relative to the height direction and the width direction and the proximal end portions of the sleeves 23 define the parts of the edge of the neck opening are generally called a "raglan sleeve." With this shape of the sleeves 23, joining portions (e.g., seams formed by joining pieces of cloth) of members respectively forming the torso portion 21 and the sleeves 23 are located outside of regions extending from the shoulders to the arms, in which the skin is greatly stretched, and therefore movements, such as raising the arms or the like, are unlikely to be interrupted and therefore a comfortable fit can be maintained.

The back torso portion 21 is made up of a low stretchable portion and a high stretchable portion respectively having different stretching ratios in the width direction. Specifically, a material having a small stretching ratio in the width direction (i.e., a material difficult to be stretched) is used for the low stretchable portion and a material having a large stretching ratio in the width direction (i.e., a material easy to be stretched) is used for the high stretchable portion.

An area in which the low stretchable portion is provided (hereinafter referred to a low stretchable area) 25 contains at least a pair of inferior angle displacing areas 27, 27 corresponding to regions in which a pair of inferior angles 4, 4 (cf. FIG. 2) are displaced when the scapula 1 is rotated. Herein, the inferior angle 4 of the scapula 1 moves within a height range from the 8th thoracic vertebra (T8) to the 7th thoracic vertebra (T7) (cf. FIG. 2) when in the upward rotation. Thus, the inferior angle displacing areas 27 each have a circular arc shape corresponding to the height position from the 8th thoracic vertebral (T8) to the 7th thoracic vertebra (T7), of the vertebral column.

Figure 4:
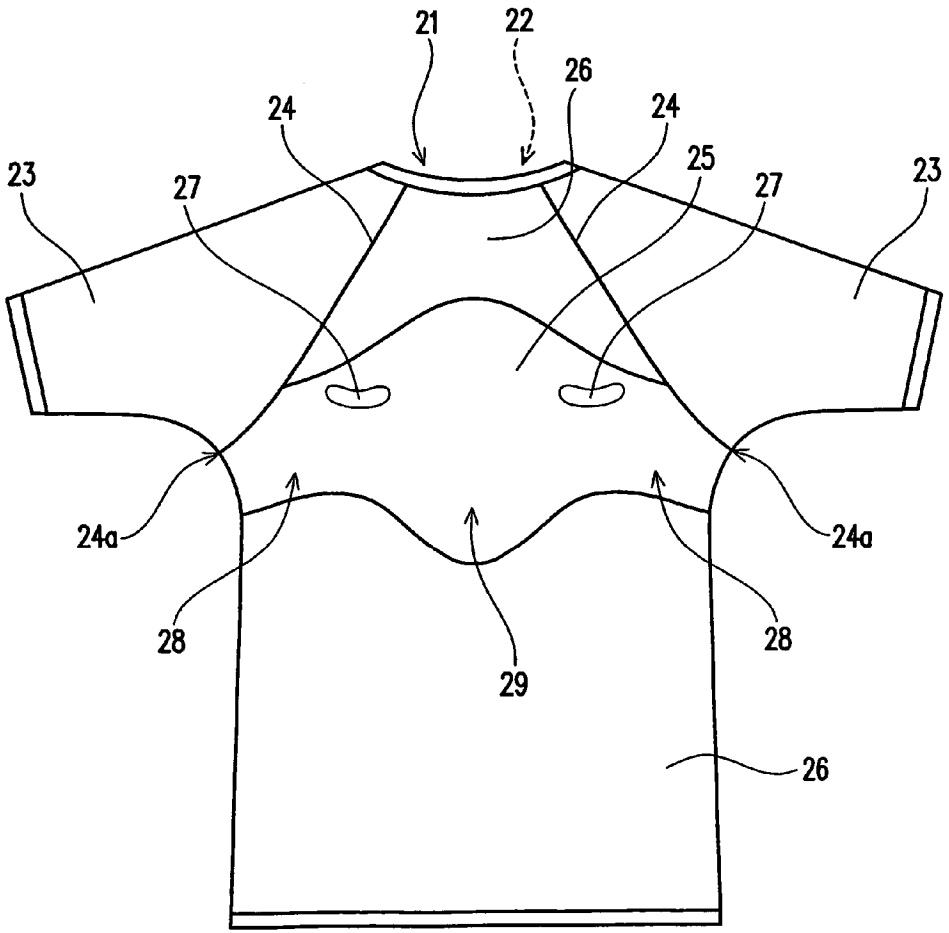
FIG. 4 is a plan view of the back side of an upper body garment according to one embodiment of the present invention.

The inferior angle displacing areas 27 are located near (located above in FIG. 4) the line segment connecting lower ends 24*a*, 24*a* of the pair of the boundaries 24, 24 between the back torso portion 21 and the sleeves 23. The inferior angle displacing areas 27 each are located at a substantially center portion between a corresponding one of the opposite lateral edges and the width center, of the torso portion 21.

The low stretchable area 25 is arranged so that a boundary between the low stretchable area 25 and an area, in which the high stretchable portion is provided (hereinafter referred to a high stretchable area) 26, is located between a region corresponding to the superior angles 2 of the scapulas 1 and the inferior angle displacing areas 27. That is, the low stretchable area 25 is arranged so as to have an upper edge extending through between the regions respectively corresponding to the superior angles 2 and the inferior angles 4.

The low stretchable area 25 is formed to extend from one end side to the opposite end side, of the torso portion 21 and has a band-like shape extending in the width direction. Specifically, the low stretchable area 25 is arranged to have the opposite lateral sides matched in position to the boundary portions of the back side and the front side. More specifically, the low stretchable area 25 is arranged to have the opposite lateral ends matched in position to the joining portions of the back torso portion 21 and the front torso portion 22 (i.e., the opposite lateral ends of the torso portion 21). The low stretchable area 25 is provided with the low stretchable portion extending continuously from one end side to the opposite end side. For example, in an upper body garment having the front part and the back part integrally (successively) formed together, although no joining portion of the back torso portion and the front torso portion exists, regions of the garment corresponding to the sides of the body of the wearer become boundaries of the back side and the front side.

In the low stretchable area 25, the height along at least the opposite lateral ends is smaller than the height at a position along the width of each of the inferior angle displacing areas 27. Herein, when tensile force has been applied to a stretchable material in an area between plural given points, this tensile force acts thereto in such a manner as to spread, at a middle position of the plural portions, in a direction orthogonal to a direction connecting those plural points. Therefore, the height, for which tensile force must be applied, is not necessary to be equal to or larger than the height of a region on which the tensile force can influence.

The low stretchable area 25 is formed to have a height that increases towards the width center. Specifically, a lower edge of the low stretchable area 25 has an outline having a center portion that extends downwards in the height direction further than the opposite lateral ends. On the other hand, an upper edge of the low stretchable area 25 has such an outline to extend upwards further as it advances towards the width center. That is, the low stretchable area 25 has the upper edge and the lower edge that extend away from each other towards the width center, thus forming a swelling shape, and has an axisymmetric shape about a line extending in the width direction at a predetermined height. Specifically, the low stretchable area 25 is formed with a line segment contained in a substantially center portion in the height direction, which line segment connects the lower end portions 24*a*, 24*a*.

The height of each of the opposite lateral ends of the low stretchable area 25 is preferably about ½ (one second) to about ⅓ (one third) of the height at the width center of the low stretchable area 25. More specifically, the height of each of the opposite lateral ends of the low stretchable area 25 becomes gradually smaller towards the corresponding outward end by utilizing the corresponding boundary 24 of the torso portion 21 and the sleeve 23, which boundary extends obliquely downwards from the neck portion to the underarm portion, of the upper body garment. That is, it is so arranged that the opposite ends of the upper edge of the low stretchable area 25 are arranged to be matched in position to the opposite ends of the boundaries 24.

Meanwhile, the low stretchable area 25 provided with the low stretchable portion therein is made up of, more specifically, two kinds of areas (lateral side areas and a center area) 28, 29. The center area 29 is defined around the width center and the two lateral side areas 28 are defined with the center area 29 therebetween.

The lateral side areas 28, 28 are areas containing at least the inferior angle displacing areas 27, 27, and act mainly to press the inferior angles of the scapulas 1 and the lower portions of the scapulas 1 towards the thoracic cage by clothing pressure generated by stretching of the low stretchable portion.

On the other hand, the center area 29 acts to give pressure stimulation to the lower fibres of the trapezius M3. Accordingly, the center area 29 is formed to correspond to the lower fibres of the trapezius M3 (cf. FIG. 3(B)), and extends the height equivalent to the inferior angle displacing areas 27. More specifically, the center area 29 has a lowermost region located at a region corresponding to the 1st lumbar vertebra L1 (cf. FIG. 2). Whereby, when the upper body garment has been worn, the lower fibres of the trapezius M3 are entirely covered by a region corresponding to the center area 29 of the low stretchable portion. The center area 29 has an uppermost region located at a region corresponding to the 6th lumbar vertebra T6 (cf. FIG. 2).

The high stretchable area 26 is defined in each of areas other than the low stretchable area 25, namely an area around the neck portion above the low stretchable area 25 and an area close to the waist below the low stretchable area 25.

For a waist portion 21, for example, 3-way knit, 2-way tricot or HKS knit (knit produced by an HKS knitting machine) is used as a base material, while power net as a low stretchable material is additionally overlapped to the low stretchable area 25. Whereby, the stretching ratios are: about 1.6 in the height direction of the low stretchable portion, about 3.3 in the width direction of the high stretchable portion and about 4 in the height direction of the high stretchable portion, in which the degree of the stretching (degree of easiness of stretching) of the low stretchable portion in the width direction is designated as 1 with reference to the time when the garment has been stretched 60%.

For the sleeves 23, in the same manner to the high stretchable portion, for example, 3-way knit, 2-way tricot or HKS knit as a high stretchable material is used.

For the front torso portion 22, it is not necessary to use a specific material, but, since the low stretchable portion is disposed in the back torso portion 21, a material having a higher stretchability than the low stretchable area 25 is arranged from the point of view of improving wearing comfort. Specifically, for the front torso portion 22, in the same manner as to the high stretchable portion in the back torso portion 21, for example, 3-way knit, 2-way tricot or HKS knit as a high stretchable material is used. However, it is possible to employ an arrangement, in which a low stretchable portion having a small stretching ratio in the width direction is also formed in the front torso portion 22 with at least its portion being vertically overlapped with the low stretchable area 25, and the low stretchable portion of the front side and the stretchable portion of the back side are continuously arranged throughout the outer circumference of the upper body garment, in order to generate high tensile force in the low stretchable portion of the back side.

Figure 5A:
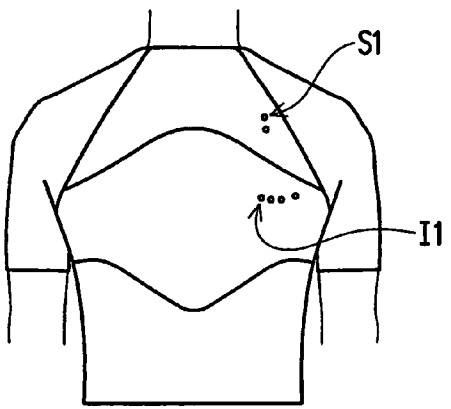
FIGS. 5(A) and 5(B) illustrate a first phase in which mainly the humerus is rotated.

Now, the description will be made for the function of the upper body garment contributed to the abduction of the arms, on the basis of FIG. 5 with reference to FIGS. 1 and 2. First, the description will be made for the first phase. In an initial position, the abduction angle of the arm is 0°, in which the scapula 1 and the humerus 10 are positioned parallel to each other. At this position, the inferior angle 4 of the scapula 1 is positioned at I1 and the superior angle 2 is positioned at S1, as illustrated in FIG. 5(A).

Then, the arm is gradually abducted from the above position, thereby causing mainly the humerus 10 to be rotated. Along with this, the scapula 1 is slightly displaced. At this moment, a region corresponding to the center area 29 of the low stretchable portion is kept at a position at which it covers the low fibres of the trapezius M3, and clothing pressure generated by the stretching of this region stimulates the low fibres of the trapezius M3.

Figure 5B:
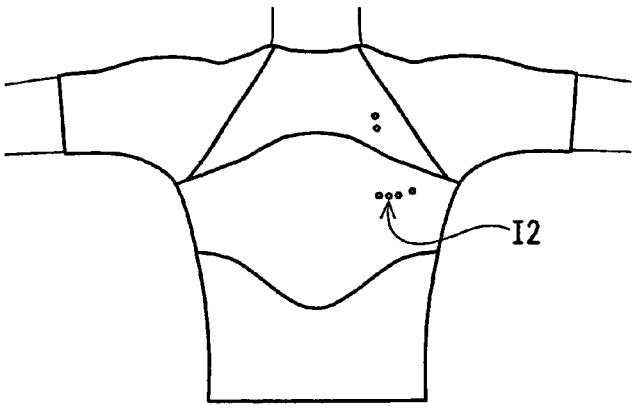

FIG. 5(B) illustrates a position at which the arm has been abducted to a position at which it is oriented perpendicular to the body. At this position, the humerus 10 is rotated about 90° and the scapula 1 is upwardly rotated about 10°. Thus, the inferior angle 4 is positioned at I2.

Now, the description will be made for the second phase. When the arm is further abducted from the above position, the scapula 1 starts to be upwardly rotated more greatly than in the first phase. At this position, a region corresponding to the lateral side areas 28 of the low stretchable portion acts to press the lower portion of the scapula 1, which includes the inferior angle 4, to the thoracic cage.

Figure 5C:
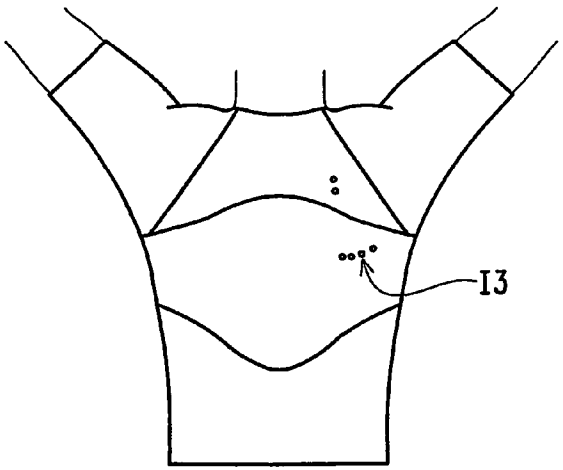
FIGS. 5(C) and 5(D) illustrate a second phase in which not only the humerus but also the scapula is rotated.
Figure 5D:
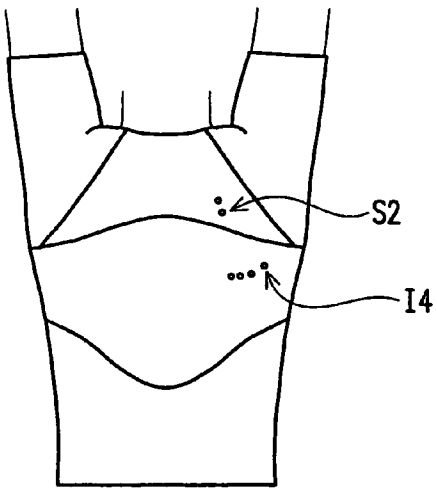

FIG. 5(C) illustrates a position, at which the abduction angle of the arm is about 125°, and at this position, the scapula 1 is upwardly rotated about 25°, and the humerus 10 is rotated about 1000. Thus, the inferior angle 4 is positioned at I3. FIG. 5(D) illustrates a position at which the abduction angle of the arm is about 160°, and at this position, the scapula 1 is upwardly rotated about 45° and the humerus 10 is rotated about 115°. Thus, the inferior angle 4 is positioned at I4. The superior angle is positioned at S2.

According to the upper body garment of this embodiment, since the low stretchable area 25 includes areas corresponding to the inferior angle displacing areas 27 and the lower portion of the scapula 1, clothing pressure generated by the low stretchable portion can be acted on a broad range including the inferior angles 4 and the lower portion of the scapula 1 during the arm raising movement and thus the scapula 1 can be pressed to the thoracic cage. Whereby, the scapula 1 can smoothly slide on the thoracic cage and hence the activities of the muscles for moving the scapula 1 can be reduced. Since the low stretchable area 25 is arranged to extend from one end side to the opposite end side in the width direction, tensile force applied from the opposite lateral sides can be efficiently acted on the low stretchable portion and hence clothing pressure can be efficiently generated. The low stretchable portion can also be stretched by friction between the low stretchable portion and its contacting surface, and can generate clothing pressure.

Especially, when the abduction of the arm is entailed, a region corresponding to the lateral side areas 28 of the low stretchable portion subserves the aforesaid first function of drawing the scapula 1 towards the thoracic cage, which is achieved by the serratus anterior M1, and hence can reduce the activity of the serratus anterior M1. Further, since the scapula 1 can take a correct position when it has been pressed towards the thoracic cage, the scapula 1 can smoothly slide on the thoracic cage, and hence the activities of the serratus anterior M1 and the upper fibres of the trapezius M2, both together acting to raise the scapula 1, can be reduced.

The low stretchable area 25 has opposite lateral ends that are matched in position to the joining portions of the back torso portion 21 and the front torso portion 22, and the low stretchable portion is arranged to extend continuously from one end side to the opposite end side without any high stretchable portion disposed therebetween, tensile force applied from the opposite lateral sides is unlikely to be absorbed and deteriorated, but efficiently acts on the low stretchable portion, thereby effectively stretching the low stretchable portion across the entire width and thus enabling clothing pressure to be more efficiently generated.

Since the height along at least the opposite lateral sides of the low stretchable area 25 is smaller than the height at a position along the width of each of the inferior angle displacing areas 27, the occupying ratio of the low stretchable area 25 becomes small relative to the entire height of each of the opposite lateral sides of the garment. Accordingly, even if the low stretchable portion is smaller in stretching ratio in the height direction than the high stretchable portion, the opposite lateral sides of the upper body garment as a whole can keep a high stretching ratio in the height direction. Although the opposite lateral sides of the upper body garment (especially, regions near the lower edge portions 24*a* corresponding to the underarm portions) are located corresponding to the sides of the body, in which the skin is greatly stretched, the thus arranged garment enables the arms to be easily raised and can maintain a comfortable fit.

Furthermore, since a region corresponding to the center area 29 of the low stretchable portion gives pressure stimulation to the lower fibres of the trapezius M3, it stimulates vigorous actions of the lower fibres of the trapezius M3 when the wearer is raising his or her arms, and hence the arm raising movement can be more easily made. Especially, when the abduction of the arm is entailed, awareness is enhanced in the first phase, so that the activities of the serratus anterior M1 and the trapezius M2 as the prima mover agonist in the subsequent second phase can be reduced.

The following experiments were made in order to verify the effects of the thus arranged upper body garment.

The subjects of a first experiment were two male adults. They in the upright position raised the dropped arms to the overhead positions in one second (abduction of the arms) and returned the same to the original positions. Two sets, each set comprising a series of these actions made ten times without break, were made to measure the electromyogram (EMG) of each of the serratus anterior, the upper fibres of the trapezius and the lower fibres of the trapezius respectively for the case in which they were naked from the waist up with no clothing (Comparative Example 1), the case in which they each wore a conventional garment (Comparative Example 2) and the case in which they each wore the upper body garment of this embodiment (Example). The conventional garments used employ only 3-way knit as a high stretchable material.

Figure 6A:
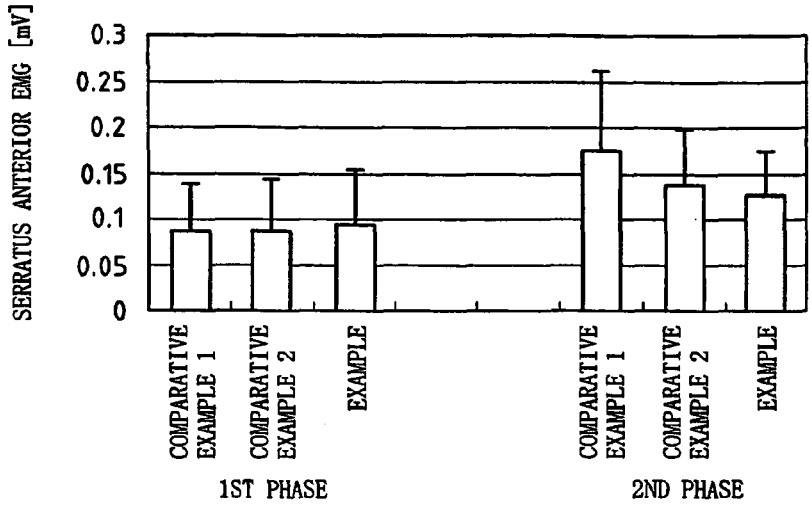
FIG. 6(A) illustrates the case for the serratus anterior.
Figure 6B:
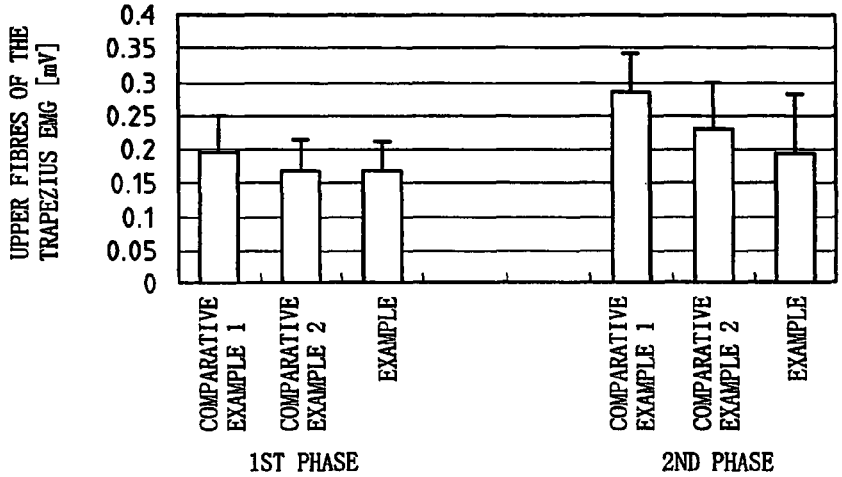
FIG. 6(B) illustrates the case for the upper fibres of the trapezium.
Figure 6C:
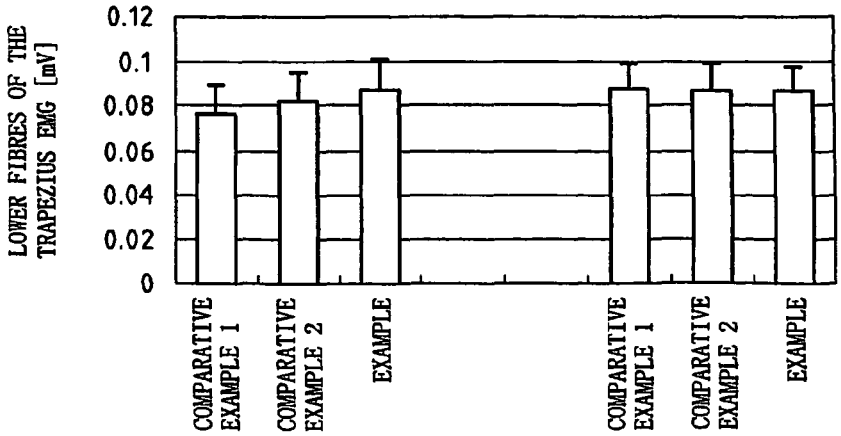
FIG. 6(C) illustrates the case for the lower fibres of the trapezium.

The results of the experiment are shown in FIG. 6. The bar graphs in FIG. 6 represent the average value of the electromyogram and the bars extending from the top of the bar graphs represent the standard deviations (similar also for those of FIG. 7). Specifically, as illustrated in FIG. 6, in the first phase (0° to about 90°), the upward rotation of the scapula 1 is not large and therefore the value of the electromyogram of each of the serratus anterior and the upper fibres of the trapezius was almost equal to that of the conventional upper body garment (cf. left columns of FIGS. 6(A) and 6(B)). On the other hand, in the second phase (about 90° to about 160°) in which the upward rotation of the scapula becomes large, it could be confirmed that the value of the electromyogram of each of the serratus anterior and the upper fibres of the trapezius was greatly reduced (cf. right columns of FIGS. 6(A) and 6(B)), that is the activities of both the muscles were greatly reduced.

It was confirmed that the value of the electromyogram of the lower fibres of the trapezius became larger than that of the conventional upper body garment in the first phase (0° to about 90°), that is, awareness was effectively enhanced by the center area 29 of the low stretchable area 25. The value of the electromyogram was almost equal to the conventional upper body garment in the second phase (about 90° to about 160°).

As a second experiment, the measurement of the electromyogram during a baseball pitching motion was made. Herein, the pitching motion is realized by adding other movements, such as back and forth movements, to the basic upward rotation of the scapula. Therefore, for the upper fibres of the trapezium, and the deltoid that is important in pitching motion, the electromyogram per height unit at elbow was measured. The measurements were made respectively for the case in which they were naked from the waist up with no clothing (Comparative Example 1), the case in which they each wore a conventional upper body garment (Comparative Example 2), and the case in which they each wore the upper body garment of this embodiment.

Herein, as the upper body garment of this embodiment, those of three types, one having sleeves with sleeve ends oriented slightly downwards relative to the width direction and being of a so-called short sleeve type having sleeve ends positioned above the elbows (Example 1), one having sleeves with sleeve ends slightly upwards relative to the width direction and being of the short sleeve type (Example 2), and one having sleeves with sleeve ends oriented slightly upwards relative to the width direction and being of a three-quarter sleeve type having sleeve ends located below the elbows (Examples 3), were used. Example 1 in the second experiment is the same as that of the example in the first experiment.

Figure 7A:
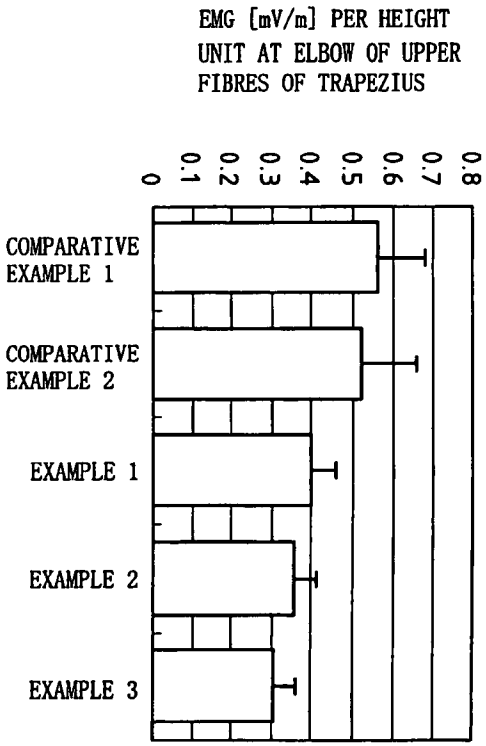
FIG. 7(A) is a view for comparison of the amount of activities of the upper fibres of the trapezius in baseball pitching.
Figure 7B:
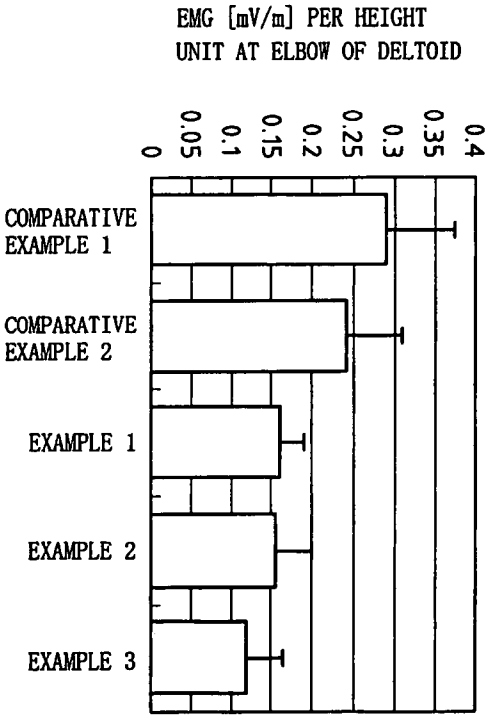
FIG. 7(B) is a view for comparison of the amount of activities of the deltoid in baseball pitching.

As a result, as illustrated in FIGS. 7(A) and 7(B), it could be confirmed that the upper body garment of this embodiment greatly reduces the electromyogram per height unit at elbow of each of the upper fibres of the trapezius (cf. FIG. 7(A)) and the deltoid (cf. FIG. 7(B)), and in other words, it reduces the activities of both the muscles.

It could also be confirmed that the upper body garment of Example 1 among the upper body garments of this embodiment further reduces the activities of the muscles compared with that of Example 2. This is because the sleeves apply forces to the arms to raise the same relative to the width direction. It could also be confirmed that the upper body garment of Example 3 further reduces the activities of the muscles compared with that of Example 2. This seems to be because the elongated sleeves further increase forces to raise the arms.

As a third experiment, they swung their arms simulating jogging, and the electromyogram per height unit at elbow was measured respectively for the case in which they were naked from the waist up with no clothing (Comparative Example 1), the case in which they each wore a conventional upper body garment (Comparative Example 2), and the case in which they each wore an upper body garment of this embodiment (Example). The Example in the third experiment is the same as that of Example 1 in the second experiment.

Figure 7C:
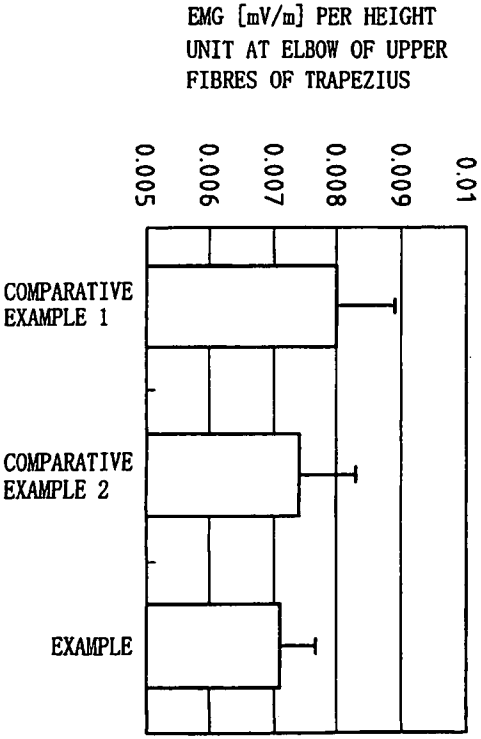
FIG. 7(C) is a view for comparison of the amount of activities of the upper fibres of the trapezius in swinging the arm.

As a result, as illustrated in FIG. 7(C), it could be confirmed that the upper body garment of this embodiment greatly reduces the electromyogram per height unit at elbow of the upper fibres of the trapezius, and in other words, it reduces the activity of the muscle. This seems to be because lifting-up of the inferior angle of the scapula can be suppressed by pressing the scapula towards the thoracic cage by the low stretchable portion and the elbows can be easily jerked back in swinging of the arms back and forth.

In the above embodiment, the behavior of the scapula was described mainly on the basis of the mechanism of the abduction of the arm, but it is a matter of course that the behavior of the scapula may be changed depending on the kind of the arm raising movements. Also, it is a matter of course that, even if the same action is made, the range of the rotation angle and the rotational displacement form, of the scapula may be changed depending on the individual. For example, the scapula may be rotated to a larger (or smaller) angle, or the scapula may be greatly rotated even in an initial stage of the arm raising movement. Furthermore, since the human body is a natural object and therefore various mechanisms are intricately intertwined with each other even for a single action, there is a possibility that the description based on a single mechanism is not accurate. In either case, it is empirically apparent that the scapula is a critical element to function in various kinds of actions involved in raising the arm. Even when the arm is raised by any individual or by taking any action, easiness in arm raising movement can be kept unchanged by pressing the scapula towards the thoracic cage. For this reason, it can be said that the above advantage can be produced even when the arm is raised by any individual or by taking any kind of action.

The garment of the present invention is not necessarily limited to the above embodiment, but various modifications may be made without departing the scope of the present invention.

For example, in the above embodiment, the center area 29 of the low stretchable area 25 located at the center portion in the width direction is formed to have a height higher than the lateral side areas 28 including the inferior angle displacing areas 27, but may be formed to have a height smaller than the same. Also, the low stretchable area 25 may have a constant height across the entire width.

In the above embodiment, the low stretchable area 25 has opposite lateral ends extending to the joining portions of the back torso portion 21 and the front torso portion 22, but the present invention is not necessarily limited thereto. The low stretchable area 25 may be arranged to extend from one end side to the opposite end side within a range not extending across the entire width, as long as it can generate clothing pressure.

In this case, a high stretchable portion having a high stretching ratio in the width direction may be provided in areas respectively extending from the boundaries of the back side and the front side to the corresponding opposite lateral ends of the low stretchable area 25 (hereinafter referred as "body side areas"). Even in this case, as mentioned above, tensile force applied from the opposite lateral sides corresponding to the body side areas of the wearer can act on the low stretchable portion, and at the same time, friction force generated by friction of the low stretchable portion and its contacting surface acts as tensile force, whereby making it possible to generate clothing pressure.

Specifically, the body side areas are designed to include at least portions near the underarm portions that are greatly displaced. It is preferable to provide these body side areas with a material having a stretching ratio being large not only in the width direction but also in the height direction. With this arrangement, the underarm portions are stretched in various directions following the actions, so that it is possible to facilitate various actions, which include actions in various directions, such as baseball pitching. More specifically, the body side areas are designed to extend downwards in the height direction from the underarm portions and extend from the underarm portions towards the ends of the arms.

In the above embodiment, the upper body garment is of a raglan sleeve type, but the present invention is not necessarily limited thereto. The upper body garment may be of a general type (set-in type) having boundary portions of the sleeves and the torso portion, which boundary portions extending from the underarm portions in the height direction, or of a semi-raglan sleeve type.

Figure 8A:
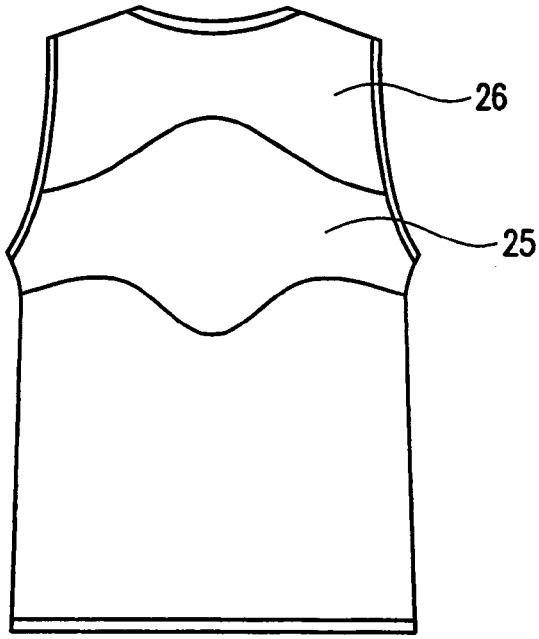
FIG. 8(A) illustrates a sleeveless type and FIG. 8(B) illustrates a so-called bra-top type.
Figure 8B:
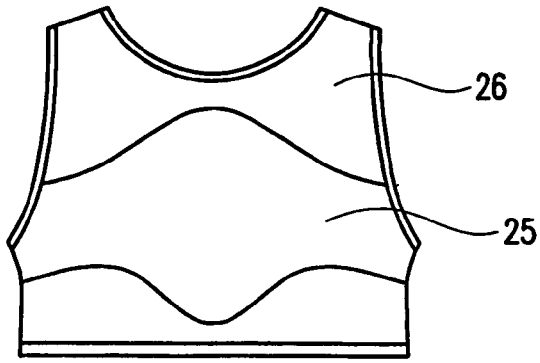

Furthermore, in the above embodiment, the upper body garment includes the sleeve portions covering the upper arms, but may be of a so-called non-sleeve type or tank top type, as illustrated in FIG. 8(A). Also, as illustrated in FIG. 8(B), the upper body garment may be of a so-called bra-top type that covers the breast and the upper portion of the back, while not covering the abdomen and the lower portion of the back.

In the above embodiment, the low stretchable portion is provided only in the predetermined area disposed with including the pair of the inferior angle displacing areas 27, but the present invention is not necessarily limited thereto. The low stretchable portion may be appropriately provided in the other area (e.g., a waist portion), as long as it does not interrupt the action to raise the arms. That is, it is essential that the garment of the present invention includes a low stretchable portion having a stretching ratio small in the width direction of the back side and disposed in the aforesaid predetermined area of the back side, and a high stretchable portion disposed in an area above the predetermined area (preferably, an area located at least above and near the predetermined area) and having a stretching ratio larger in the width direction of the back side than that of the predetermined area.

In the above embodiment, as a high stretchable material and a low stretchable material, 3-way knit, 2-way tricot, HKS knit or power net is used, but the present invention is not necessarily limited thereto. Cloth having a desired elastic modulus may be produced and used by appropriately changing the kind of knitting yarn, knitting density, knitting structure or number of knitting yarns. As the low stretchable material, not only the cloth such as the aforesaid power net, but also, for example, resin sheet such as polyurethane, or silicone printed on a high stretchable material, may be employed. The low stretchable portion may be formed by appropriate joining, sewing or processing of any stretchable material, following any means or methods.

The invention claimed is:

1. A garment characterized in that a predetermined area of the back side of the garment comprises a material having a stretching ratio smaller in the width direction of the back side than that of at least an area near a neck portion of the back side, said predetermined area extending from one end side to the opposite end side in the width direction of the back side of the garment and containing at least areas in which the inferior angles of the right and left scapulas are respectively displaced during raising the arms, said predetermined area applying pressure against a back area of a wearer, wherein the predetermined area is arranged to have opposite lateral ends matched in position to boundaries of the back side and the front side.

2. A garment characterized in that a predetermined area of the back side of the garment comprises a material having a stretching ratio smaller in the width direction of the back side than that of an area of the back side other than said predetermined area, said predetermined area extending from one end side to the opposite end side in the width direction of the back side of the garment and containing at least areas in which the inferior angles of the right and left scapulas are respectively displaced during raising the arms, said predetermined area applying pressure against a back area of a wearer, wherein the predetermined area is arranged to have opposite lateral ends matched in position to boundaries of the back side and the front side.

3. A garment characterized in that a predetermined area of the back side of the garment comprises a material having a stretching ratio smaller in the width direction of the back side than that of at least an area near a neck portion of the back side, said predetermined area extending from one end side to the opposite end side in the width direction of the back side of the garment and containing at least areas in which the inferior angles of the right and left scapulas are respectively displaced during raising the arms, said predetermined area applying pressure against a back area of a wearer, wherein the predetermined area has opposite lateral ends each having a height smaller than the height of a portion of the predetermined area, which portion containing at least the areas, in which the inferior angles of the scapulas are displaced.

4. A garment characterized in that a predetermined area of the back side of the garment comprises a material having a stretching ratio smaller in the width direction of the back side than that of an area of the back side other than said predetermined area, said predetermined area extending from one end side to the opposite end side in the width direction of the back side of the garment and containing at least areas in which the inferior angles of the right and left scapulas are respectively displaced during raising the arms, said predetermined area applying pressure against a back area of a wearer, wherein the predetermined area has opposite lateral ends each having a height smaller than the height of a portion of the predetermined area, which portion containing at least the areas, in which the inferior angles of the scapulas are displaced.

5. A garment characterized in that a predetermined area of the back side of the garment comprises a material having a stretching ratio smaller in the width direction of the back side than that of at least an area near a neck portion of the back side, said predetermined area extending from one end side to the opposite end side in the width direction of the back side of the garment and containing at least areas in which the inferior angles of the right and left scapulas are respectively displaced during raising the arms, said predetermined area applying pressure against a back area of a wearer, wherein the predetermined area has a center portion in the width direction that extends downward in the height direction.

6. A garment characterized in that a predetermined area of the back side of the garment comprises a material having a stretching ratio smaller in the width direction of the back side than that of an area of the back side other than said predetermined area, said predetermined area extending from one end side to the opposite end side in the width direction of the back side of the garment and containing at least areas in which the inferior angles of the right and left scapulas are respectively displaced during raising the arms, said predetermined area applying pressure against a back area of a wearer, wherein the predetermined area has a center portion in the width direction that extends downward in the height direction.

7. A garment characterized in that a predetermined area of the back side of the garment comprises a material having a stretching ratio smaller in the width direction of the back side than that of at least an area near a neck portion of the back side, said predetermined area extending from one end side to the opposite end side in the width direction of the back side of the garment and containing at least areas in which the inferior angles of the right and left scapulas are respectively displaced during raising the arms, said predetermined area applying pressure against a back area of a wearer, wherein the predetermined area is provided at only the back side.

8. A garment characterized in that a predetermined area of the back side of the garment comprises a material having a stretching ratio smaller in the width direction of the back side than that of at least an area near a neck portion of the back side, said predetermined area extending from one end side to the opposite end side in the width direction of the back side of the garment and containing at least areas in which the inferior angles of the right and left scapulas are respectively displaced during raising the arms, said predetermined area applying pressure against a back area of a wearer, wherein the material of the predetermined area has a stretching ratio in the height direction of larger than that in the width direction thereof.

9. The garment according to any one of claims 1 to 8, wherein the predetermined area is arranged to have boundaries to the area of the back side other than the predetermined area, said boundaries being respectively located between areas in which the superior angles of the scapulas are displaced and the areas in which the inferior angles of the scapulas are displaced.

10. The garment according to any one of claims 1 to 8, wherein said predetermined area is stretched during upward rotation of the scapulas when raising the arms of the wearer, thereby generating clothing pressure which presses the scapulas toward a thoracic cage.

11. The garment according to any one of claims 1 to 8, wherein said predetermined area comprises a center area in a width direction of a back side of the garment and lateral side areas with said center area therebetween, and said lateral side areas are stretched during raising the arms of the wearer, thereby generating clothing pressure which presses the scapulas toward a thoracic cage.

12. The garment according to any one of claims 1 to 8, wherein said predetermined area comprises a center area in a width direction of a back side of the garment and lateral side areas with said center area therebetween, said center area is sized to cover lower fibres of the trapezius, said center area being stretched during abduction of the arms, thereby generating clothing pressure which stimulates the lower fibres of the trapezius, and said lateral side areas are stretched during raising the arms of the wearer, thereby generating clothing pressure which presses the scapulas toward a thoracic cage.

13. A garment comprising:

a front side; and a back side having a first area of a first material extending down from a neck portion of the garment;

a second area of the first material extending up from a bottom portion of the garment; and a third area of a second material attached between the first and second areas and extending across the width of the back side of the garment, the third area terminating at boundaries of the back side and the front side; the second material having a smaller stretching ratio along the width of the back side of the garment than the first material.

14. The garment of claim 13, wherein the third area is not in contact with the neck portion of the garment.

15. The garment of claim 13, wherein the front side includes an area comprising the second material.

16. The garment of claim 13, wherein the third area extends over the inferior areas of the scapulas when worn by a user.

17. The garment of claim 13, wherein at least a portion of the third area extends to edges of the back side of the garment below the location of sleeves on the garment.

18. The garment of claim 13, wherein the third area extends to edges of the back side of the garment at the location and below the location of sleeves on the garment.

* * * * *